US010907381B2

(12) United States Patent
Lien

(10) Patent No.: US 10,907,381 B2
(45) Date of Patent: Feb. 2, 2021

(54) ELECTRONIC DOOR LOCK WITH A MONITORING UNIT

(71) Applicant: WFE Technology Corp., Taichung (TW)

(72) Inventor: Chih-Min Lien, Taichung (TW)

(73) Assignee: WFE Technology Corp., Taichung (TW)

( * ) Notice: Subject to any disclaimer, the term of this patent is extended or adjusted under 35 U.S.C. 154(b) by 471 days.

(21) Appl. No.: 16/011,738

(22) Filed: Jun. 19, 2018

(65) Prior Publication Data

US 2019/0383060 A1 Dec. 19, 2019

(51) Int. Cl.

| | |
|---|---|
| ***E05B 63/08*** | (2006.01) |
| ***E05B 17/04*** | (2006.01) |
| ***E05B 45/12*** | (2006.01) |
| ***E05B 45/08*** | (2006.01) |
| ***E05B 47/02*** | (2006.01) |
| ***E05B 17/20*** | (2006.01) |
| ***G08B 13/08*** | (2006.01) |
| ***E05B 47/06*** | (2006.01) |
| *E05B 47/00* | (2006.01) |
| *E05B 45/06* | (2006.01) |

(52) U.S. Cl.

CPC ..... *E05B 63/08* (2013.01); *E05B 17/044* (2013.01); *E05B 17/2026* (2013.01); *E05B 45/083* (2013.01); *E05B 47/026* (2013.01); *E05B 47/068* (2013.01); *G08B 13/08* (2013.01); *E05B 45/12* (2013.01); *E05B 2045/064* (2013.01); *E05B 2045/0635* (2013.01); *E05B 2045/0665* (2013.01); *E05B 2045/0695* (2013.01); *E05B 2047/0068* (2013.01); *E05B 2047/0069* (2013.01)

(58) Field of Classification Search

CPC . E05B 3/00; E05B 3/08; E05B 17/044; E05B 17/045; E05B 45/083; E05B 2045/064; E05B 2045/0635; E05B 2045/065; E05B 2045/0665; E05B 47/0603; E05B 47/0657; E05B 47/0661; E05B 47/0665; E05B 47/0673; E05B 47/0676; E05B 47/068; E05B 47/0684; E05B 47/0692; E05B 2047/0067; E05B 2047/0068; E05B 2047/0069; E05B 63/0065; E05B 63/04; E05B 63/044; E05B 63/08; E05C 1/06; E05C 1/12; E05C 1/16

See application file for complete search history.

(56) References Cited

U.S. PATENT DOCUMENTS 6,354,121 B1 * 3/2002 Frolov ..... E05B 47/0692 292/144
6,539,755 B1 * 4/2003 Bruwer ..... E05B 47/0012 292/165

(Continued)

*Primary Examiner* — Christopher J Boswell
(74) *Attorney, Agent, or Firm* — Burris Law, PLLC

(57) ABSTRACT

An electronic door lock includes a dead bolt moved by a deadbolt transmitting assembly, a spring-loaded latch bolt moved by a latchbolt transmitting assembly, a lock core rotated by a core transmitting assembly, and a spring-loaded prying resisting member. A monitoring unit includes sensors respectively corresponsive to those assemblies and the prying resisting member, and a security controller which performs a security procedure in accordance with position of those assemblies and the prying resisting member sensed by the sensors.

3 Claims, 5 Drawing Sheets

(56) References Cited

U.S. PATENT DOCUMENTS

| | | | | |
|---|---|---|---|---|
| 7,051,561 | B2 * | 5/2006 | Moon | E05B 47/0673 340/5.6 |
| 8,079,238 | B2 * | 12/2011 | Lin | E05B 65/1086 70/107 |
| 8,424,935 | B2 * | 4/2013 | Moon | E05B 63/0056 292/244 |
| 9,617,757 | B2 * | 4/2017 | Lowder | E05B 17/2084 |
| 10,526,816 | B2 * | 1/2020 | Chiou | E05B 63/146 |
| 2018/0340352 | A1 * | 11/2018 | Compton | E05B 47/0611 |
| 2019/0119962 | A1 * | 4/2019 | Lien | E05B 63/14 |
| 2020/0219347 | A1 * | 7/2020 | Lv | E05B 47/0012 |

* cited by examiner

X

X

ELECTRONIC DOOR LOCK WITH A MONITORING UNIT

FIELD

The disclosure relates to an electronic door lock, and more particularly to an electronic door lock with a monitoring unit to record and surveil operations thereof.

BACKGROUND

A conventional electronic door lock includes a housing, a spring-loaded latch bolt unit, a deadbolt unit, a prying resisting unit, a lock core unit and an operating unit. The operating unit includes an internal operating handle and an external operating handle, and is operable to move the latch bolt unit and the deadbolt unit when the door lock is unlocked to permit opening of a door. The deadbolt unit is a complement to the spring-loaded latch bolt unit to make the door harder to open without using a correct key. The latch bolt unit and the deadbolt unit are operated by the lock core unit. Since the component parts and operation thereof of the conventional electronic door lock are of a known art, a detailed description is dispensed with herein.

The conventional electronic door lock can be connected with a control assembly to be controlled and monitored to lock and unlock. However, a person with bad intention may follow behind and enter a building when the door lock is unlocked and held opened for seconds, which causes serious security threats. Moreover, no warning alarm is provided once a thief breaks the door lock and enters into the building.

SUMMARY

Therefore, an object of the disclosure is to provide an electronic door lock with a monitoring unit that can alleviate at least one of the drawbacks of the prior art.

According to the disclosure, the electronic door lock includes a housing, a dead bolt unit, a latch bolt unit, a lock core unit, a prying resisting unit, an operating unit, a control unit and a monitoring unit.

The housing has two side plates spaced apart from each other in a left-and-right direction to define a receiving space therebetween, and a lock plate disposed normal to the side plates and interconnecting front sides of the side plates. The dead bolt unit is disposed in the receiving space, and has a dead bolt which is movable in a front-and-rear direction through the lock plate, and a deadbolt transmitting assembly which is linked to move the dead bolt. The latch bolt unit is disposed in the receiving space, and has a latch bolt which is movable in the front-and-rear direction through the lock plate, a latchbolt transmitting assembly which is linked to move the latch bolt, and a latchbolt spring which is disposed to bias the latch bolt forwardly through the lock plate. The lock core unit has a cylinder which is securely disposed on one of the side plates, a core which is rotatably mounted in the cylinder to be operatively actuated by a mechanical key, and a core transmitting assembly which is linked to both the deadbolt transmitting assembly and the latchbolt transmitting assembly and which is actuated by a rotation of the core to move the deadbolt transmitting assembly and the latchbolt transmitting assembly. The prying resisting unit is disposed in the receiving space, and has a prying resisting member which is movable in the front-and-rear direction through the lock plate, and a prying resisting spring which is disposed to bias the prying resisting member forwardly through the lock plate. The operating unit has a swingable linkage assembly which is disposed in the receiving space, which is linked to both the deadbolt transmitting assembly and the latchbolt transmitting assembly, and which is swingable by an operated torque to move the deadbolt transmitting assembly and the latchbolt transmitting assembly, an external actuated member which is disposed in the receiving space and rotatable to provide the operated morgue to the swingable linkage assembly, an internal actuated member which is disposed in and rotatable relative to the external actuated member, a clutch pin which is disposed in and movable relative to the external driving member between an engaged position, where the clutch pin is engaged with the internal actuated member so as to allow synchronous rotation of the external actuated member with the internal actuated member, and a disengaged position, where the clutch pin is disengaged from the internal actuated member so as to allow an idle rotation of the internal actuated member relative to the external actuated member, an electric driving assembly which is disposed in the receiving space to operatively actuate movement of the clutch pin between the engaged and disengaged positions, an internal operating handle which has an internal driving section that extends into the receiving space through one of the side plates to be in engagement with and rotate the external actuated member, and an external operating handle which has an external driving section that extends into the receiving space through the other one of the side plates to be in engagement with and rotate the internal actuated member. The control unit includes a control circuit board which is connected electrically with the electric driving assembly to control operation of the electric driving assembly, and a battery which is disposed to supply power to the control circuit board. The monitoring unit includes a deadbolt sensor corresponsive to the deadbolt transmitting assembly, a latchbolt sensor corresponsive to the latchbolt transmitting assembly, a prying resisting sensor corresponsive to the prying resisting member, a core sensor corresponsive to the core transmitting assembly and a security controller connected electrically with the deadbolt sensor, the latchbolt sensor, the prying resisting sensor and the core sensor to perform a security procedure in accordance with positions of the deadbolt transmitting assembly, the latchbolt transmitting assembly, the prying resisting member and the core transmitting assembly respectively sensed by the deadbolt sensor, the latchbolt sensor, the prying resisting sensor and the core sensor.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
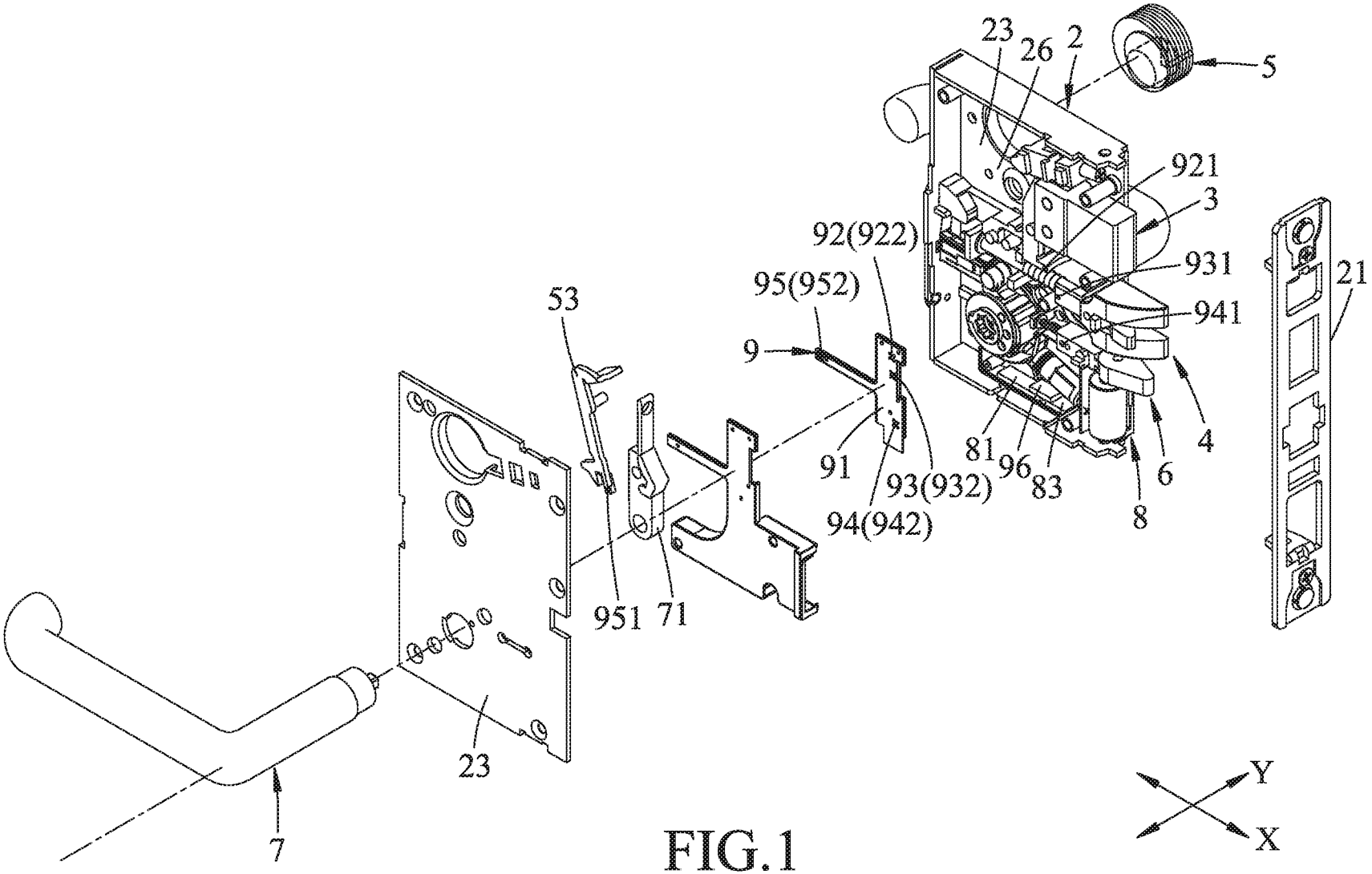
FIG. 1 is a partly-exploded perspective view illustrating an embodiment of an electronic door lock according to the disclosure.
Figure 2:
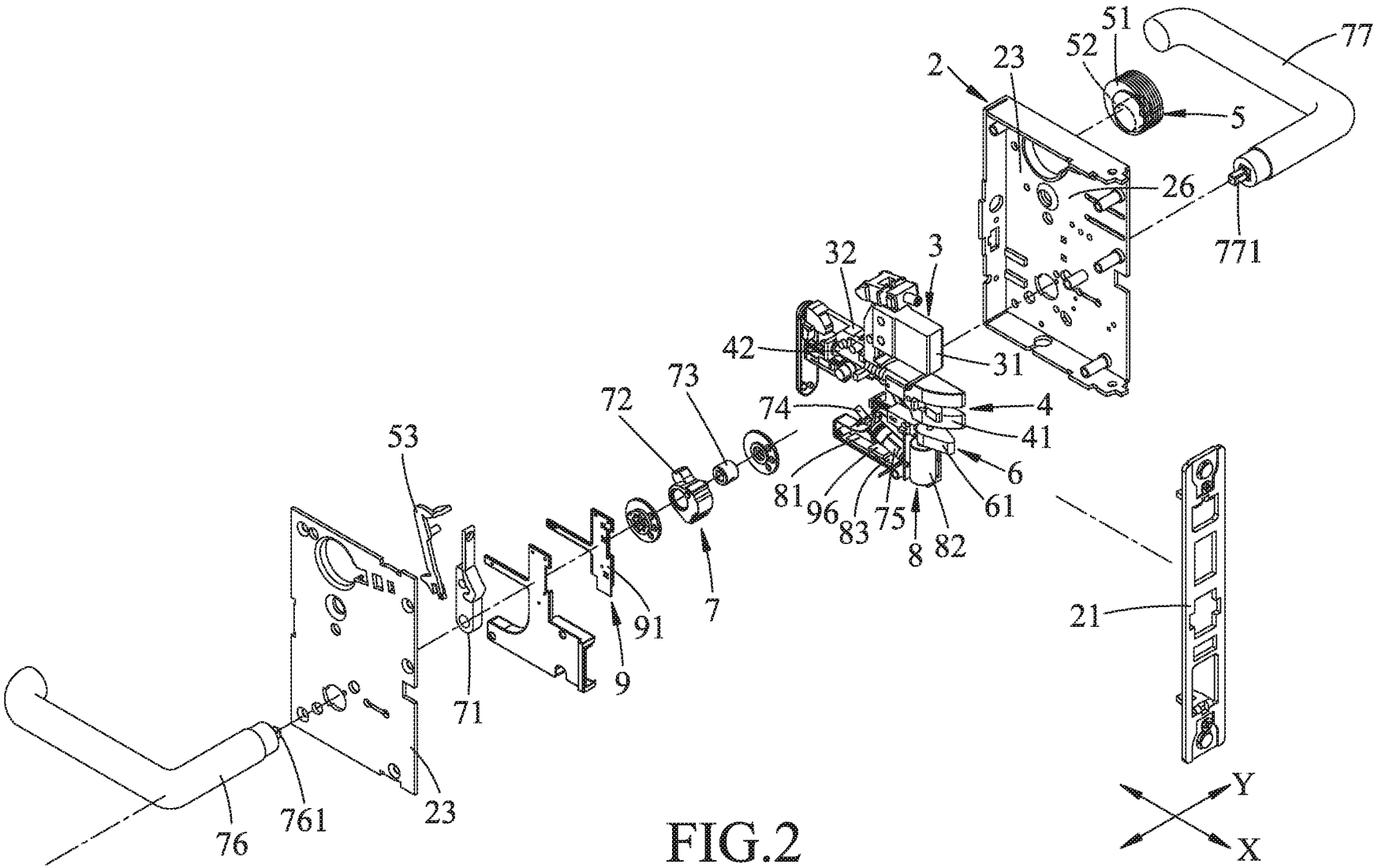
FIG. 2 is an exploded perspective view of the embodiment.
Figure 3:
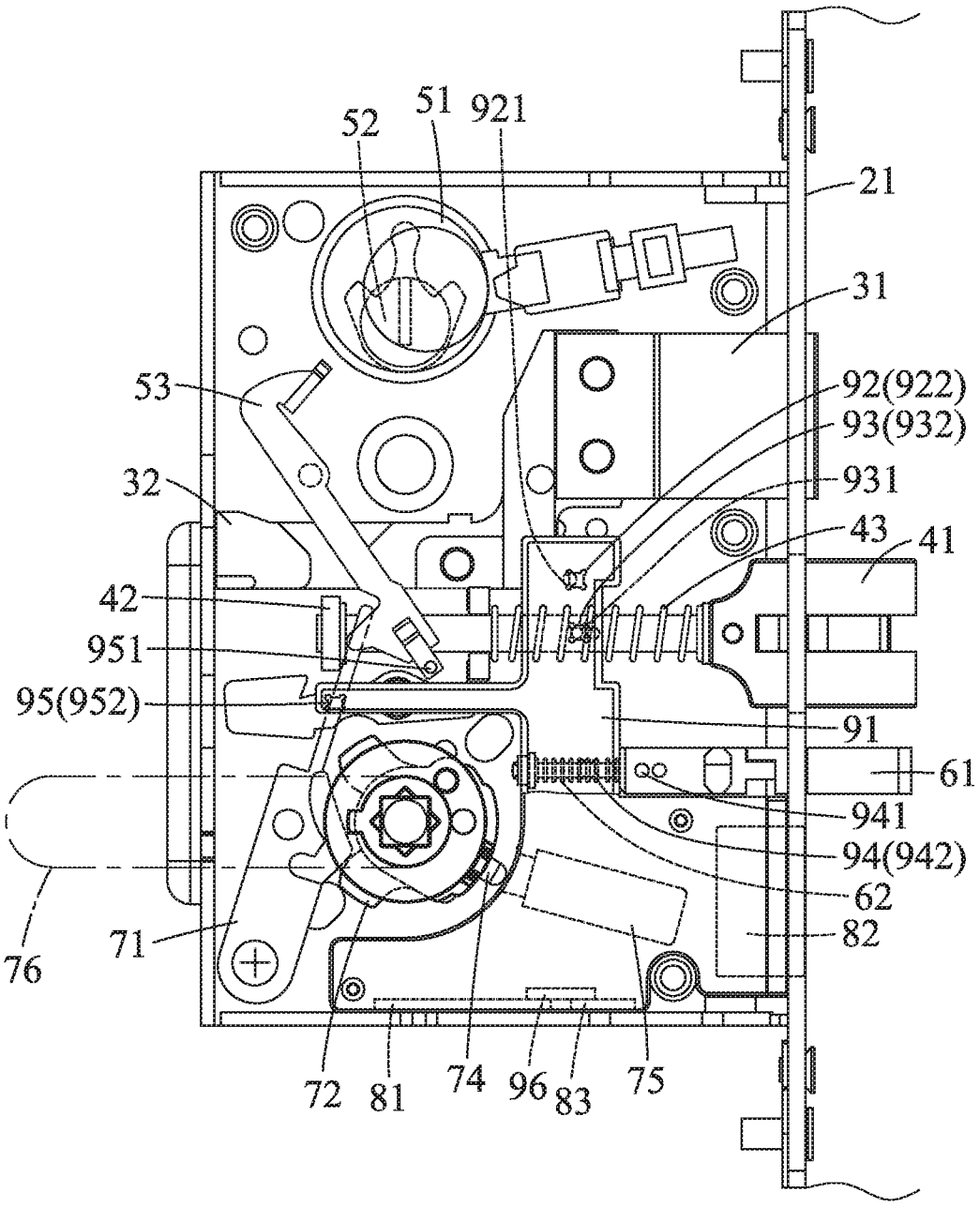
FIG. 3 is a schematic view illustrating the embodiment in a state when an internal operating handle s not turned.

Referring to FIGS. 1 to 3, an embodiment of an electronic door lock according to the disclosure includes a housing 2, a dead bolt unit 3, a latch bolt unit 4, a lock core unit 5, a prying resisting unit 6, an operating unit 7, a control unit 8 and a monitoring unit 9.

The housing 2 has two side plates 23 spaced apart from each other in a left-and-right direction (Y) to define a receiving space 26 therebetween, and a lock plate 21 disposed normal to the side plates 23 and interconnecting front sides of the side plates 23.

The dead bolt unit 3 is disposed in the receiving space 26, and has a dead bolt 31 which is movable in a front-and-rear direction (X) through the lock plate 21, and a deadbolt transmitting assembly 32 which is linked to move the dead bolt 31.

The latch bolt unit 4 is disposed in the receiving space 26 and below the dead bolt unit 3, and has a latch bolt 41 which is movable in the front-and-rear direction (X) through the lock plate 21, a latchbolt transmitting assembly 42 which is linked to move the latch bolt 41, and a latchbolt spring 43 which is disposed to bias the latch bolt 41 forwardly through the lock plate 21.

The lock core unit 5 has a cylinder 51 which is securely disposed on one of the side plates 23, a core 52 which is rotatably mounted in the cylinder 51 to be operatively actuated by a mechanical key (not shown), and a core transmitting assembly 53 which is linked to both the deadbolt transmitting assembly 32 and the latchbolt transmitting assembly 42, and which is actuated by a rotation of the core 52 to move the deadbolt transmitting assembly 32 and the latchbolt transmitting assembly 42.

The prying resisting unit 6 is disposed in the receiving space 26 and below the latch bolt unit 4, and has a prying resisting member 61 which is movable in the front-and-rear direction (X) through the lock plate 21, and a prying resisting spring 62 which is disposed to bias the prying resisting member 61 forwardly through the lock plate 21.

Figure 4:
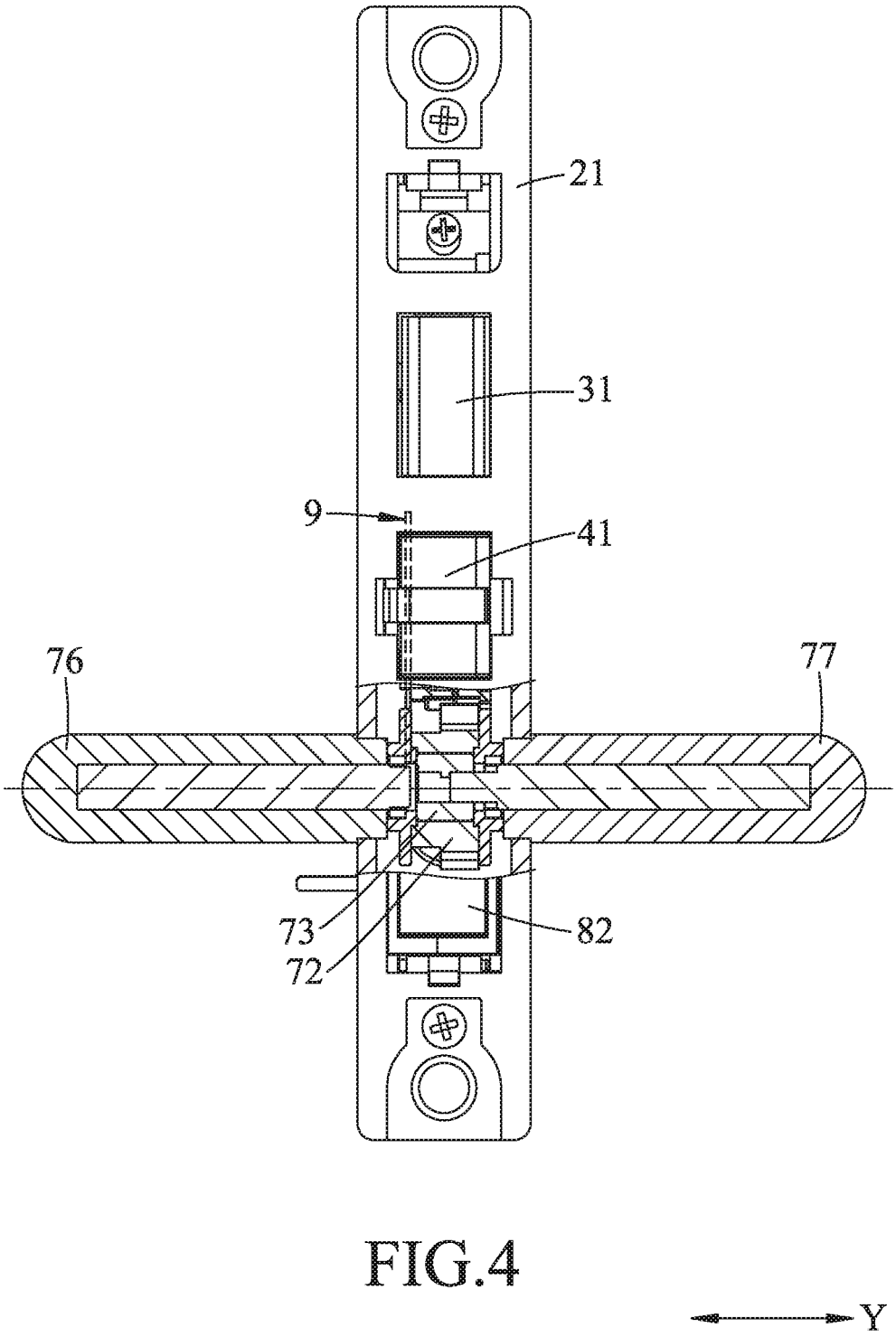
FIG. 4 is a partly-sectional side view of the embodiment.

With reference to FIGS. 2 to 4, the operating unit 7 has a swingable linkage assembly 71 which is disposed in the receiving space 26, which is linked to both the deadbolt transmitting assembly 32 and the latchbolt transmitting assembly 42, and which is swingable by an operated torque to move the deadbolt transmitting assembly 32 and the latchbolt transmitting assembly 42, an external actuated member 72 which is disposed. In the receiving space 26 and rotatable to provide the operated torque to the swingable linkage assembly 71, an internal actuated member 73 which is disposed in and rotatable relative to the external actuated member 72, a clutch pin 74 which is disposed in and movable relative to the external driving member 72 between an engaged position, where the clutch pin 74 is engaged with the internal actuated member 73 so as to allow synchronous rotation of the external actuated member 72 with the internal actuated member 73, and a disengaged position, where the clutch pin 74 is disengaged from the internal actuated member 73 so as to allow an idle rotation of the internal actuated member 73 relative to the external actuated member 72, an electric driving assembly 75 which is disposed in the receiving space 26 to operatively actuate movement of the clutch pin 74 between the engaged and disengaged positions, an internal operating handle 76 which has an internal driving section 761 that extends into the receiving space 26 through one of the side plates 23 to be in engagement with and rotate the external actuated member 72, and an external operating handle 77 which has an external driving section 771 that extends into the receiving space 26 through the other one of the side plates 23 to be in engagement with and rotate the internal actuated member 73.

The control unit 8 includes a control circuit board 81 which is connected electrically with the electric driving assembly 75 to control operation of the electric driving assembly 75, a battery 82 which is disposed to supply power to the control circuit board 81, and a Bluetooth receiving module 83 which is electrically connected with the control circuit board 81.

With reference to FIGS. 1, 3 and 4, the monitoring unit 9 includes a mounting plate 91 securedly disposed in the receiving space 26, a deadbolt sensor 92 corresponsive to the deadbolt transmitting assembly 32, a latchbolt sensor 93 corresponsive to the latchbolt transmitting assembly 42, a prying resisting sensor 94 corresponsive to the prying resisting member 61, a core sensor 95 corresponsive to the core transmitting assembly 53, and a security controller 96 connected electrically with the deadbolt sensor 92, the latchbolt sensor 93, the prying resisting sensor 94 and the core sensor 95 to perform a security procedure in accordance with positions of the deadbolt transmitting assembly 32, the latchbolt transmitting assembly 42, the prying resisting member 61 and the core transmitting assembly 53 respectively sensed by the deadbolt sensor 92, the latchbolt sensor 93, the prying resisting sensor 94 and the core sensor 95.

The deadbolt sensor 92 has a first hall sensing member 922 which is mounted on the mounting plate 91, and a first magnetic member 921 which is disposed on and displaceable with the deadbolt transmitting assembly 32 such that a magnetic field generated thereby is changed when the first magnetic member 921 is displaced with the deadbolt transmitting assembly 32 so as to give off a signal indicative of the position of the deadbolt transmitting assembly 32.

The latchbolt sensor 93 has a second hall sensing member 932 which is mounted on the mounting plate 91, and a second magnetic member 931 which is disposed on and displaceable with the latchbolt transmitting assembly 42 such that a magnetic field generated thereby is changed when the second magnetic member 931 displaced with the latchbolt transmitting assembly 42 so as to give off a signal indicative of the position of the latchbolt transmitting assembly 42.

The prying resisting sensor 94 has a third hall sensing member 942 which is mounted on the mounting plate 91, and a third magnetic member 941 which is disposed on and displaceable with the prying resisting member 61 such that a magnetic field generated thereby is changed when the third magnetic member 941 is displaced with the prying resisting member 61 so as to give off a signal indicative of the position of the prying resisting member 931.

The core sensor 95 has a fourth hall sensing member 952 which is mounted on the mounting plate 91, and a fourth magnetic member 951 which is disposed on and displaceable with the core transmitting assembly 53 such that a magnetic field generated thereby is changed when the fourth magnetic member 951 is displaced with the core transmitting assembly 53 so as to give off a signal indicative of the position of the core transmitting assembly 53.

The operations of the electronic door lock of the embodiment are as follows.

When a door used with the electronic door lock is locked, i.e., the clutch pin 74 is in the disengaged position, an idle rotation of the internal actuated member 73 relative to the external actuated member 72 is allowed. In this state, the internal operating handle 76 is manually operated to rotate the external actuated member 72, and the swingable linkage assembly 71 is thus swung to move the deadbolt transmitting assembly 32 and the latchbolt transmitting assembly 42 so as to retreat the dead bolt 31 and the latch bolt 41 in the receiving space 26 for allowing opening of the door. On the other hand, when the external operating handle 77 is manually operated, an idle rotation of the internal actuated member 73 is carried out, and the external actuated member 72 is not driven so as to prevent opening of the door from the exterior of the door.

Figure 5:
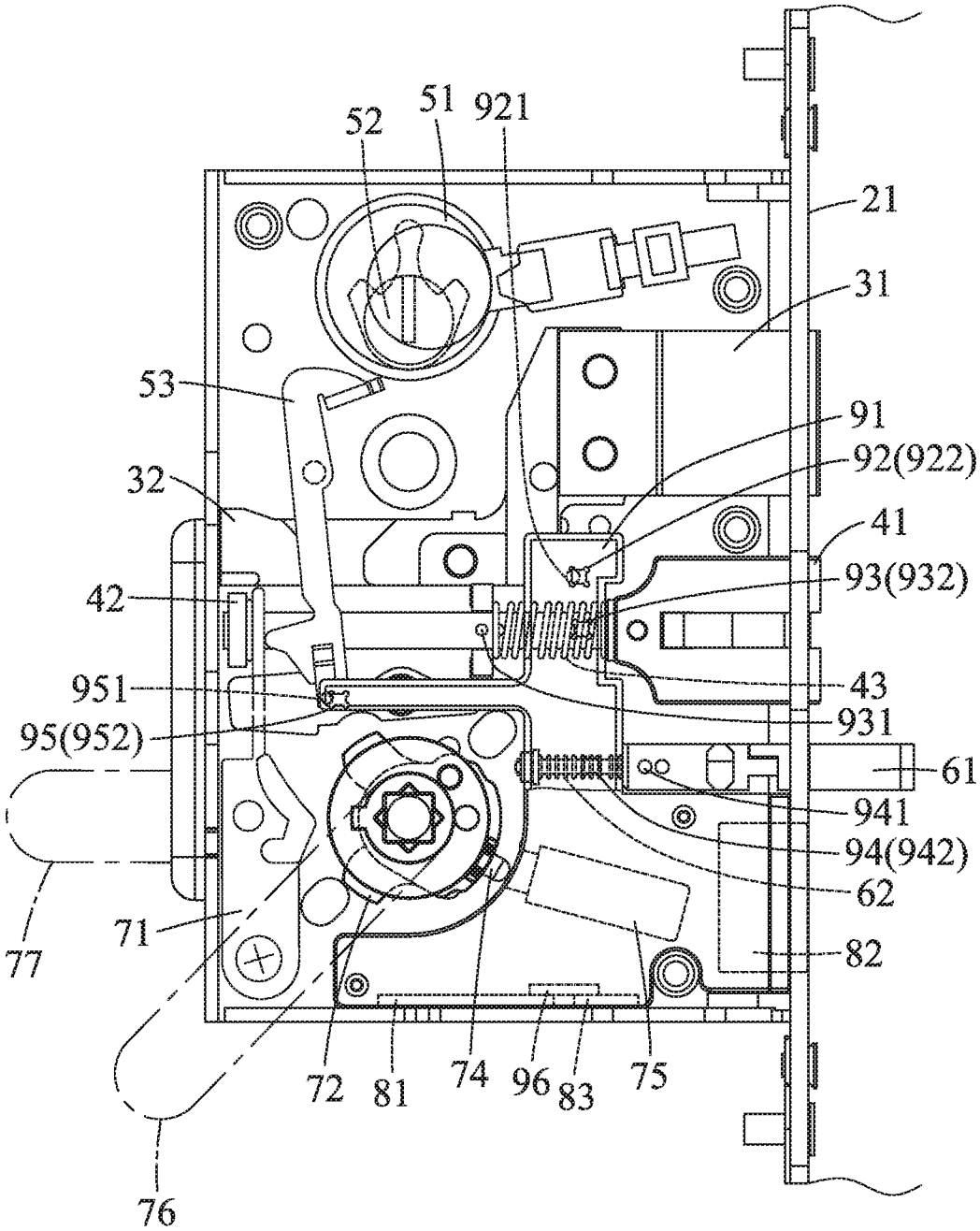
FIG. 5 is a view similar to FIG. 3, illustrating a state when the internal operating handle is turned.

With reference to FIGS. 1, 2 and 5, when a bluetooth signal from a cell phone (not shown) to unlock the door is received by the Bluetooth receiving module 83, or when a signal from a card key unit (not shown) is received by the control unit 8, the control unit 8 directs to operate the electric driving assembly 75 to actuate the movement of the clutch pin 74 to the engaged position such that operation of either the internal operating handle 76 or the external operating handle 77 makes the synchronous rotation of the internal actuated member 73 and the external actuated member 72 to retreat the latch bolt 41 so as to allow opening of the door.

When the core 52 of the lock core unit 5 is operatively actuated by a mechanical override key to rotate relative to the cylinder 51, the core transmitting assembly 53, the deadbolt transmitting assembly 32 and the latchbolt transmitting assembly 42 are moved to retreat the dead bolt 31 and the latch bolt 41 the receiving space 26 for releasing the lock.

When the door panel is closed such that the lock plate 21 is aligned with and faces a door frame, the prying resisting member 61 abuts against the door frame to be retreated in the receiving space 26. Once the door panel is opened from the door frame, the prying resisting member 61 is moved by the biasing action of the prying resisting spring 62 to project outwardly of the receiving space 26.

Since the motions of the dead bolt 31, the latch bolt 41 and the core 52 are respectively synchronized with those of the deadbolt transmitting assembly 32, the latchbolt transmitting assembly 42 and the core transmitting assembly 53, through the changes of the magnetic field generated by the deadbolt sensor 92, the latchbolt sensor 93, the prying resisting sensor 94 and the core sensor 95 during the displacements of the deadbolt transmitting assembly 32, the latchbolt transmitting assembly 42, the prying resisting member 61 and the core transmitting assembly 53, which can be measured and recorded by the security controller 96, a variety of security procedures can be performed.

For example, one security procedure is as follows.

1. When the dead bolt 31 projects out of the lock plate 21, the security controller 96 is responsible for generating a signal in accordance with the position of the deadbolt transmitting assembly 32 that is displayed on a display screen (not shown) mounted at the exterior of the door. A user located exteriorly of the door is aware that a mechanical key is needed to unlock the door.

2. The security controller 96 is responsible for recording the time when displacement of the cord transmitting assembly 53 occurs so as to facilitate checking and surveilling the time when a mechanical key is used, thereby avoiding improper usage of the mechanical key by others.

3. The security controller 96 is responsible for recording the time when displacement of the swingable linkage assembly 71 occurs, and then driving the electric driving assembly 75 to move the clutch pin 74 to the disengaged position in a predetermined time (for example, 5 seconds) to interrupt the transmission of the external operating handle 77 to lock the door so as to prevent the door from being reopened by a follower.

4. The security controller 96 is responsible for generating a signal in accordance with the position of the prying resisting member 61 only when the prying resisting member 61 is projected out of the receiving space 26, and taking actions responsive to the signal, such as triggering an alarm.

As illustrated, with the deadbolt sensor 92, the latchbolt sensor 93, the prying resisting sensor 94 and the core sensor 95 disposed to generate the changes of magnetic field during the displacements of the deadbolt transmitting assembly 32, the latchbolt transmitting assembly 42, the prying resisting member 61 and the core transmitting assembly 53, a variety of security procedures can be performed by the security controller 96 to surveil and record the operations of the deadbolt unit 3, the latch bolt unit 4, the prying resisting unit 6 and the lock core unit 5 for a variety of conditions so as to enhance security.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electronic door lock comprising:

a housing having two side plates spaced apart from each other in a left-and-right direction to define a receiving space therebetween, and a lock plate disposed normal to said side plates and interconnecting front sides of said side plates;

a dead bolt unit disposed in said receiving space, and having a dead bolt which is movable a front-and-rear direction through said lock plate, and a deadbolt transmitting assembly which is linked to move said dead bolt;

a latch bolt unit disposed in said receiving space, and having a latch bolt which is movable in the front-and-rear direction through said lock plate, a latchbolt transmitting assembly which is linked to move said latch bolt, and a latchbolt spring which is disposed to bias said latch bolt forwardly through said lock plate;

a lock core unit having a cylinder which is securely disposed on one of said side plates, a core which is rotatably mounted in said cylinder to be operatively actuated by a mechanical key, and a core transmitting assembly which is linked to both said deadbolt transmitting assembly and said latchbolt transmitting assembly and which is actuated by a rotation of said core to move said deadbolt transmitting assembly and said latchbolt transmitting assembly;

a prying resisting unit disposed in said receiving space, and having a prying resisting member which is movable in the front-and-rear direction through said lock plate, and a prying resisting spring which is disposed to bias said prying resisting member forwardly through said lock plate;

an operating unit having a swingable linkage assembly which is disposed in said receiving space, which is linked to both said deadbolt transmitting assembly and said latchbolt transmitting assembly, and which is swingable by an operated torque to move said deadbolt transmitting assembly and said latchbolt transmitting assembly, an external actuated member which is disposed in said receiving space and rotatable to provide the operated torque to said swingable linkage assembly, an internal actuated member which is disposed in and rotatable relative to said external actuated member, a clutch pin which is disposed in and movable relative to said external driving member between an engaged position, where said clutch pin is engaged with said internal actuated member so as to allow synchronous rotation of said external actuated member with said internal actuated member, and a disengaged position, where said clutch pin is disengaged from said internal actuated member so as to allow an idle rotation of said internal actuated member relative to said external actuated member, an electric driving assembly which is disposed in said receiving space to operatively actuate movement of said clutch pin between the engaged and disengaged positions, an internal operating handle which has an internal driving section that extends into said receiving space through one of said side plates to be in engagement with and rotate said external actuated member, and an external operating handle which has an external driving section that extends into said receiving space through the other one of said side plates to be in engagement with and rotate said internal actuated member;

a control unit including a control circuit board which is connected electrically with said electric driving assembly to control operation of said electric driving assembly, and a battery which is disposed to supply power to said control circuit board; and a monitoring unit including a deadbolt sensor corresponsive to said deadbolt transmitting assembly, a latchbolt sensor corresponsive to said latchbolt transmitting assembly, a prying resisting sensor corresponsive to said prying resisting member, a core sensor corresponsive to said core transmitting assembly, and a security controller connected electrically with said bolt sensor, said latchbolt sensor, said prying resisting sensor and said core sensor to perform a security procedure in accordance with positions of said deadbolt transmitting assembly, said latchbolt transmitting assembly, said prying resisting member and said core transmitting assembly respectively sensed by said deadbolt sensor, said latchbolt sensor, said prying resisting sensor and said core sensor.

2. The electronic door lock as claimed in claim 1, wherein said monitoring unit further includes a mounting plate securedly disposed in said receiving space, said deadbolt sensor having a first hall sensing member which is mounted on said mounting plate, and a first magnetic member which is disposed on and displaceable with said deadbolt transmitting assembly such that a magnetic field generated thereby is changed when said first magnetic member is displaced with said deadbolt transmitting assembly so as to give off a signal indicative of the position of said deadbolt transmitting assembly, said latchbolt sensor having a second hall sensing member which is mounted on said mounting plate, and a second magnetic member which is disposed on and displaceable with said latchbolt transmitting assembly such that a magnetic field generated thereby is changed when said second magnetic member is displaced with said latchbolt transmitting assembly so as to give off a signal indicative of the position of said latchbolt transmitting assembly, said prying resisting sensor having a third hall sensing member which is mounted on said mounting plate, and a third magnetic member which is disposed on and displaceable with said prying resisting member such that a magnetic field generated thereby is changed when said third magnetic member is displaced with said prying resisting member so as to give off a signal indicative of the position of said prying resisting member, said core sensor having a fourth hall sensing member which is mounted on said mounting plate, and a fourth magnetic member which is disposed on and displaceable with said core transmitting assembly such that a magnetic field generated thereby is changed when said fourth magnetic member is displaced with said core transmitting assembly so as to give off a signal indicative of the position of said core transmitting assembly.

3. The electronic door lock as claimed in claim 2, wherein said control unit further includes a Bluetooth receiving module electrically connected with said control circuit board.

* * * * *